United States Patent [19]

Lahm et al.

[11] 4,413,457

[45] Nov. 8, 1983

[54] CHECKERED WALL OR CEILING SYSTEM

[75] Inventors: Albert H. Lahm; Paul D. LaLonde, both of Lorain, Ohio

[73] Assignee: Donn Incorporated, Westlake, Ohio

[21] Appl. No.: 231,597

[22] Filed: Feb. 5, 1981

[51] Int. Cl.[3] ..... B44F 7/00

[52] U.S. Cl. ..... 52/314; 52/145; 52/311; 52/484; 52/630; 52/675; 52/772; 52/802; 52/823

[58] Field of Search ..... 52/145, 311, 314, 484, 52/634, 690, 696, 772, 777, 823, 630, 802, 805, 675

[56] References Cited

U.S. PATENT DOCUMENTS

| | | | |
|---|---|---|---|
| 1,669,639 | 8/1927 | Waldron | 52/314 |
| 2,271,871 | 2/1939 | Newport et al. | 52/145 |
| 2,689,711 | 9/1954 | Wichert | 52/675 |
| 3,859,770 | 1/1975 | Chambers | 52/484 |

*Primary Examiner*—Alfred C. Perham
*Assistant Examiner*—Mark J. Sofia
*Attorney, Agent, or Firm*—Pearne, Gordon, Sessions, McCoy, Granger & Tilberry

[57] ABSTRACT

A suspension ceiling or wall system is disclosed providing a plurality of spaced, rectangular pans or projections positioned in spaced relationship in a pattern to provide a ceiling or wall surface with the appearance of a plurality of such pans suspended in space. The pans are formed from sheet metal into elongated members having a plurality of pans supported by integral, longitudinally extending rails. The rails are provided with a dark color contrasting with a relatively light color on the exposed portion of the pans so as to obscure the presence of the connecting rails.

15 Claims, 6 Drawing Figures

CHECKERED WALL OR CEILING SYSTEM

BACKGROUND OF INVENTION

This invention relates generally to panels for walls or ceilings, and more particularly to a novel and improved panel structure for providing an interior finish surface of walls or ceilings and to a novel and improved method of producing such panels.

PRIOR ART

Many types of panel systems are known for providing the interior finish of walls and/or ceilings. For example, rectangular panels are often positioned in suspension ceiling grid systems. Generally, such panels are supported along their edges by inverted tees forming the grid. In such systems, the panels are usually unitary elements which are provided with a surface treatment such as that found in acoustical tile or the like, and the finished surface of the wall or ceiling is provided by such surface treatment. In some instances, the grids are exposed and are apparent when the system is viewed, and in other instances, the grids are concealed and the panels provide the entire visible surface.

In another known panel system, metal sheets have been slit in a pattern and the metal is deep-drawn along the slits to provide a panel having projecting square or rectangular pans extending from the lower surface of the sheet in a spaced pattern relationship. Such pans, however, have been open on opposite sides where the slits were formed prior to the drawing operation and along such sides appear to have a thickness only equal to the thickness of the metal forming the panel. Also, the webs between the pans are generally very apparent in an installed system.

Other types of ceiling and wall systems, often referred to as "linear" systems or ceilings, provide a plurality of channel-shaped members which are supported in a side-by-side relationship and cooperate to provide a system surface consisting of a plurality of spaced and parallel channel bases. Examples of such systems are illustrated in U.S. Pat. Nos. 3,645,051 and 3,678,641.

In such linear systems, the channel members are often spaced from each other to provide longitudinal openings through which conditioning air, etc. may pass. In some instances, a dark glass fiber mat or the like is positioned over all or a portion of the openings. Such mats provide a dark contrasting background between the channels, and also provide for sound absorption.

SUMMARY OF INVENTION

In accordance with the present invention, a novel and improved panel system is provided for ceilings or walls. In such system, a finished appearance somewhat similar to a checkerboard is provided. The finished appearance is that of a plurality of separate squares or rectangles, referred to as "pans" herein, positioned in spaced relationship and aligned in two directions to provide an attractive pattern.

The supporting structure for the pans is preferably obscured so that a visual impression is given of a pattern of square or rectangular pans suspended in space. In the illustrated embodiment, the supporting structure is colored black and the pans are a relatively light color. Further, the supporting structure is spaced back from the exposed pan surfaces. The dark color of the supporting system and its location back from the exposed surface of the pans obscures the supporting surface when the panels are viewed and creates the visual impression that the pans are suspended in space.

The structure is also arranged so that the spaces between the pans are substantially open and when a dark (preferably black) sound absorbing material such as a glass fiber mat is positioned behind the panels, the system provides superior sound absorption characteristics.

In the illustrated embodiment, elongated, unitary members provide a plurality of pans supported in aligned, spaced relationship by a pair of support rails which are integrally formed along opposite sides of the pans and which are joined with opposite pairs of pan sides. A plurality of such elongated members are connected in spaced relationship to provide a composite panel which is mounted in a typical suspended ceiling grid system.

The illustrated elongated members are formed from a single sheet of metal which, prior to forming, is coated on one side with a black coating and on the other side with the desired light color. Such strip is roll-formed into a channel shape in which the spaced legs of the channel provide integral support rails extending the length of the member, and which are connected to and support the spaced pan portions. The material forming the base of the channel is pierced at intervals, and is bent up to provide pan sides which extend laterally of the member. The piercing operation also cuts away a portion of the channel legs adjacent to the channel base to separate the pans and leave the portions of the channel legs which provide the longitudinal panel sides.

The upper portions of the channel legs provide the support rails. Such upper portions are provided with a reverse bend, with the reversely bent portion extending down to the upper edge of the longitudinal pan sides. This reverse bend serves two purposes. First, it results in a double wall thickness along the rails for greater strength. Second, it provides a structure in which the dark black coating of the strip is exposed on both sides of the rails. Therefore, the light color coating of the portion of the sheet which ultimately forms the rails is fully concealed.

Since the rails are spaced back from the base surface of the pans and have a relatively dark color, the support system is substantially unnoticed in an assembled system. Further, the pans are formed with four sides of the same exposed color as the pan base, and the sides extend back from the pan base to provide a rectangular pan which has the appearance of substantial thickness.

The structure is economically produced by roll-forming, and allows the use of prepainted or precoated material, eliminating any requirement that the finished product need be painted or that separate colors need be applied along specific areas of the finished product.

These and other aspects of the present invention are more fully discussed in the following specification and drawings.

DETAILED DESCRIPTION OF THE DRAWINGS

Figure 1:
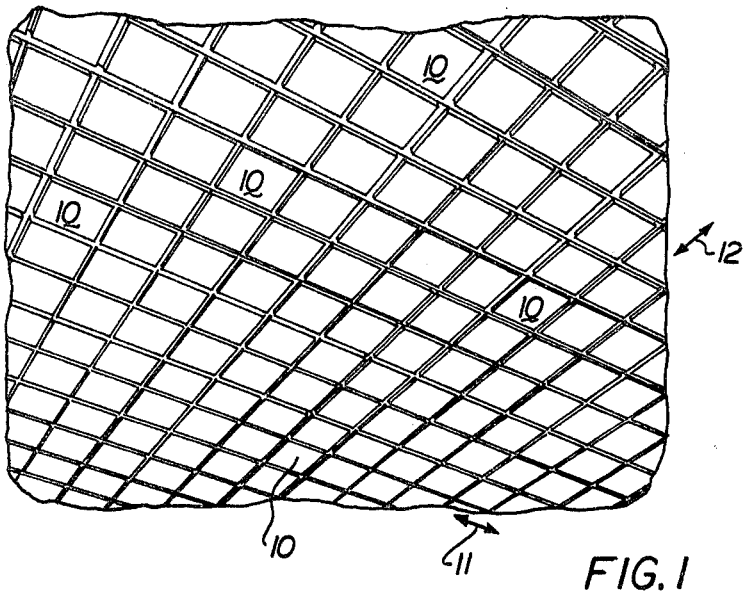
FIG. 1 is a fragmentary, perspective view of a ceiling structure in accordance with the present invention.
Figure 2:
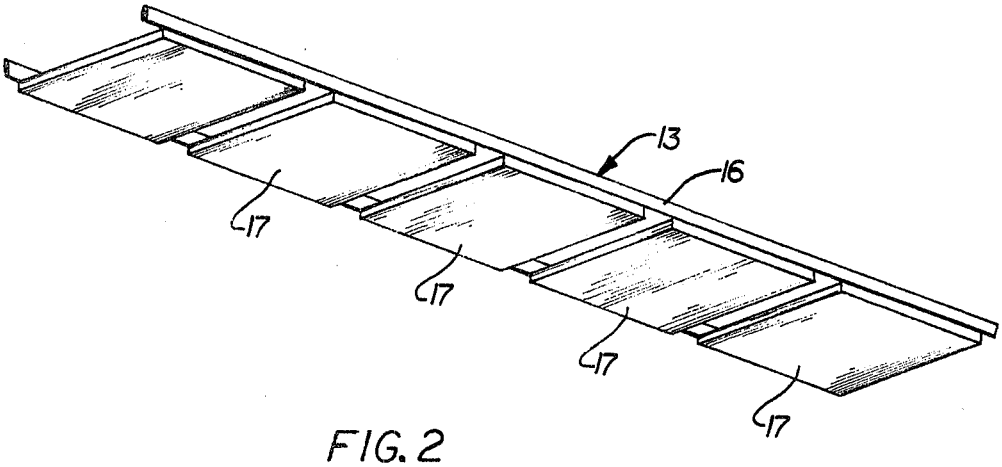
FIG. 2 is an enlarged, fragmentary perspective of a portion of one of the elongated members formed in accordance with this invention.
Figure 3:
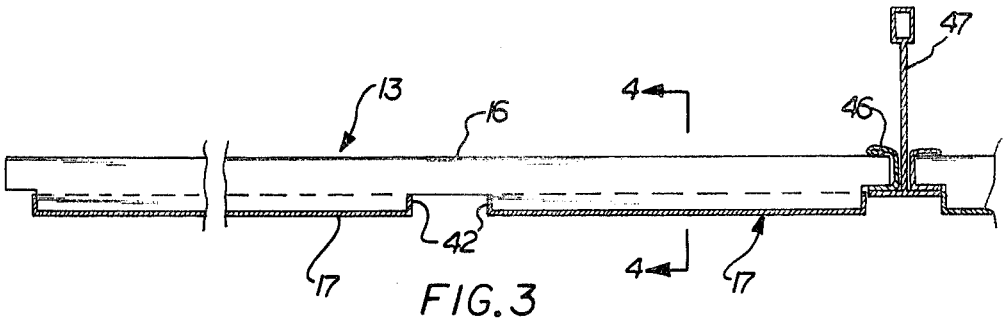
FIG. 3 is an enlarged, fragmentary side elevation in longitudinal section of the members illustrated in FIG. 2.
Figure 4:
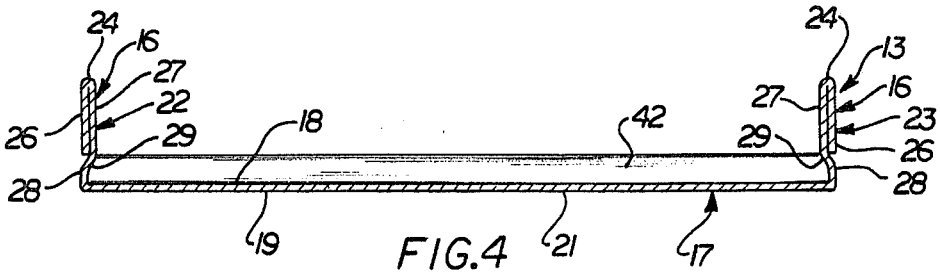
FIG. 4 is an enlarged cross section taken along 4—4 of FIG. 3.

Referring to FIG. 1, the illustrated embodiment of this invention provides a ceiling structure consisting of a plurality of square pans 10 aligned in one direction indicated by the directional arrow 11 and aligned in a second direction perpendicular thereto indicated by the directional arrow 12. Although the pans illustrated are square, this invention may also be applied to rectangular pans. The pans are provided by a plurality of side-by-side elongated members 13 illustrated in FIGS. 2 through 5 and, in the illustrated embodiment, are supported at their ends on a typical suspension ceiling grid system consisting of inverted tee-shaped grid members 14.

Each of the elongated members 13 is formed from a single piece of sheet metal which is preferably pierced and roll-formed to the required shape. The finished member 13 includes a pair of spaced and substantially parallel rails 16 extending the length of the member and a plurality of spaced pans 17 supported along opposite edges by the rails 16. Prior to the forming operation, the metal sheet from which the members are formed is coated with a dark color, preferably black, on its back side 18 and with a relatively light color on its front or exposed side 19. The color selected for the front or exposed side 19 is the finish color of the ceiling or wall assembled from the elongated members 13.

During the forming process, the metal is pierced and formed to a channel or U-shape providing a planar base portion 21 and parallel leg portions 22 and 23. The two legs 22 and 23 are each formed with an outwardly folded reverse bend 24 to provide a downwardly or reversely bent portion 26 which extends down along and in contact with an upwardly extending portion 27. The two portions 26 and 27 cooperate to provide the rails 16, which are double thickness.

The purpose of the reverse bend and the downwardly extending portion 26 is twofold. First, it provides a doubling of the thickness of the rails for strength, and second, it provides a structure in which the dark coating along the back side 18 of the sheet material is exposed on both sides of the rail 16. In this way, the front coating of light color is fully obscure along the rails and the rails are, in the preferred embodiment, black along both sides.

Preferably, the reversely bent portion 26 only extends back along the sides of the legs a distance equal to about two-thirds of the total leg height, leaving a pan side portion 28 about one-third the height of the legs which has the light color coating of the front exposed face. This side portion 28 forms two opposite sides of each pan 17. It also provides the support connection between the respective pans and the support rails 16. Preferably, the legs are formed with slight offsets at 29 so that the side portions 28 are coplanar with the reversely bent portion 26.

Figure 6:
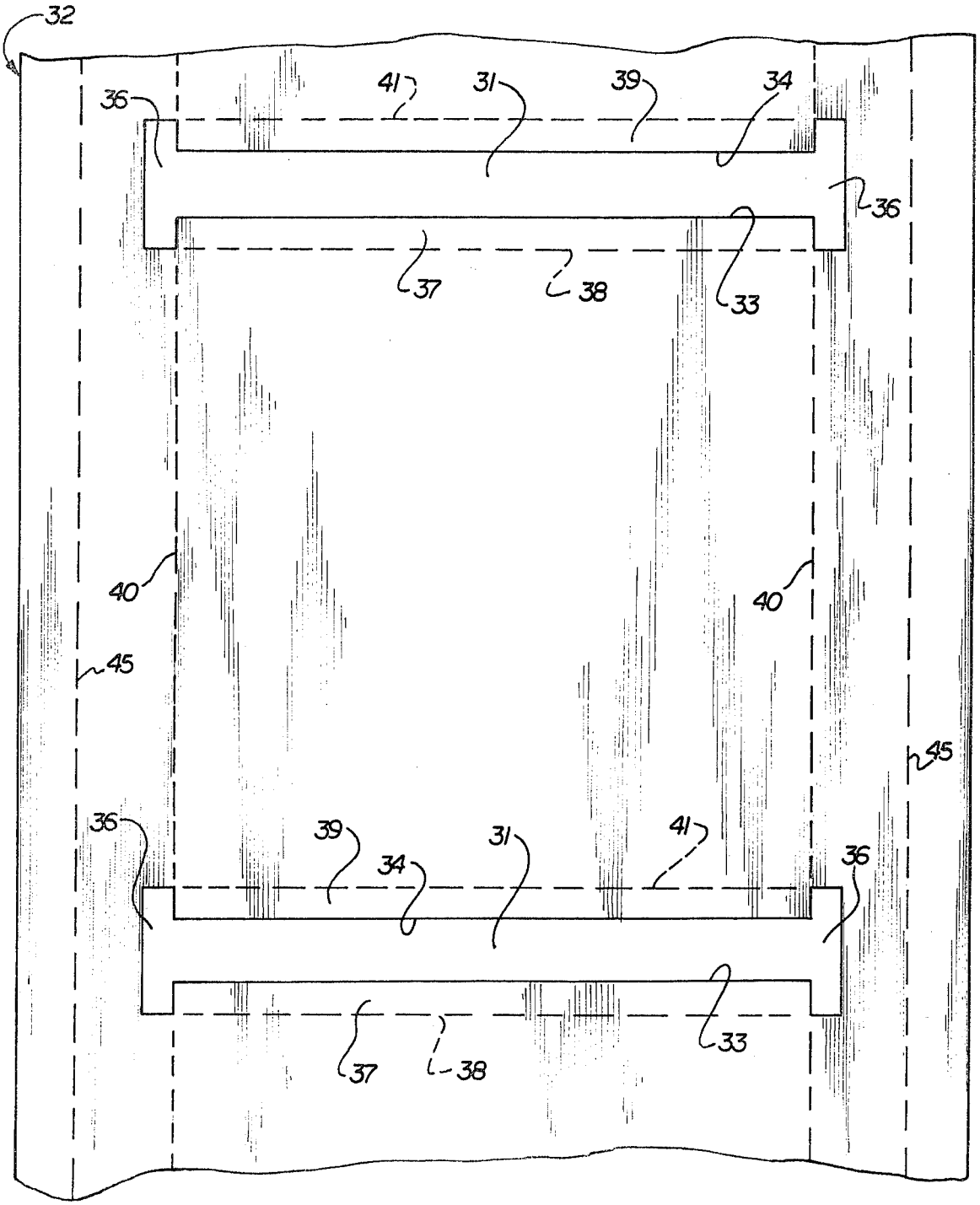
FIG. 6 is a plan view of a portion of the metal strip from which the elongated element is formed prior to the bending operations.

During the manufacture of the member, the strip is pierced at intervals to remove generally "I" sections 31 of the strip as illustrated in FIG. 6. Each opening 31 has a central portion extending laterally of the sheet 32 between edges 33 and 34. At the ends of the opening are longitudinal portions 36. Such a piercing operation leaves a first portion 37 between the edge 33 and a bend line 38 and a second portion 39 between the edge 34 and a bend line 41. These portions 37 and 39 are bent up during the forming of the member to produce lateral sidewalls 42 which extend laterally of the member and cooperate to provide the remaining two opposed sidewalls of each pan. Thus, the pans 17, which are either square or rectangular, have four sidewalls which extend back from the base 21 of the pan and provide the appearance of a pan of substantial thickness. Between the walls 42 of adjacent pans is an opening extending the width of the member. The dotted lines 40 in FIG. 6 are the lines of the bends between the base of the channel and the legs, and the dotted lines 45 are the lines along which the reverse bends 24 are made.

Figure 5:
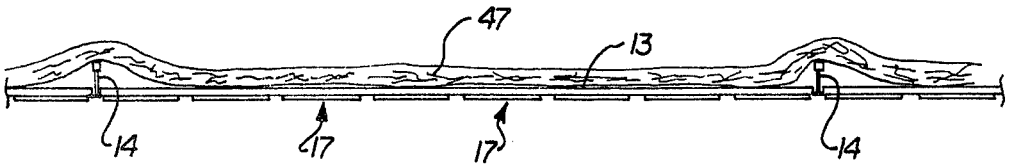
FIG. 5 is a fragmentary side elevation of a portion of the ceiling illustrated in FIG. 1.

In the embodiment illustrated in FIG. 5, the elongated members 13 are supported at their ends by two parallel tee-shaped grid members. If, for example, the pans are five inches square and are spaced by about one inch, an elongated member having eight pans 17 will bridge between two grid members 14 four feet apart. If the grid structure is arranged to provide grid openings which are four feet square, eight elongated members positioned in side-by-side relationship will cooperate to completely fill the opening when the members, which are five inches wide, are spaced one inch apart. In such example, the grid opening will contain 64 pans arranged in a pattern as illustrated in FIG. 1. Preferably in such instance, a U-shaped connector 46 interconnects the eight elongated members at their ends to form a unitary panel assembly which can be installed as a unit within the grid and which operates to maintain the proper spacing between adjacent elongated members.

In instances in which the grid is assembled with openings which are two feet by four feet, similar elongated members are used, but only four members are assembled in a given panel. The connectors 46 rest on the flanges of the tees 14 so that the tees between the ends pans of the elongated members are exposed. It is therefore preferable to provide tees having a black exposed surface.

In an assembled ceiling, there is a space between each of the pans within a given elongated member and also a space between the pans of adjacent members. Preferably, a blanket 47 is laid over the panels and is formed of a black colored material so that the openings are visually obscured in an assembled ceiling. It is also preferable where sound damping is desired to form such blankets of a sound-absorbing material such as glass fiber mats.

Because the pans are relatively light colored and the entire supporting structure for the pans, including the grid, are dark or black, and because such supporting structure is spaced back from the plane of the ceiling provided by the bases 21 of the pans, such supporting structure is not noticeable and is obscured in an assembled ceiling. Further, the black background provided by the blanket 47 obscures the supporting structure and closes the openings. The visual appearance of a ceiling or wall structure in accordance with the present invention is that of a pattern of square or rectangular pans spaced from each other and suspended in space.

Although the present invention is illustrated as applied to a ceiling, it is equally applicable to wall structures when desired. Further, the invention may be applied to a linear type ceiling in which individual channel-shaped elongated members 13 are supported from above by a support which is not exposed in the manner illustrated, but which provide support substantially as illustrated in the U.S. patents listed above.

Because the channel-shaped elongated members are formed by roll-forming and do not require painting or coating after they are formed, low manufacturing costs can be achieved. Further, since an opening is provided around each pan over which a sound-deadening blanket is positioned, very high sound-absorbing characteristics are provided by a finished ceiling or wall in accordance with the present invention.

Although the preferred embodiment of this invention has been shown and described, it should be understood that various modifications and rearrangements of the parts may be resorted to without departing from the scope of the invention as disclosed and claimed herein.

What is claimed is:

1. A wall, ceiling, and the like comprising a plurality of elongated members each formed from a single piece of sheet material, each member providing a pair of parallel support rails extending the length thereof and a plurality of spaced substantially rectangular pans, each pan including a rectangular planar base portion and sidewalls extending back from the plane of said base portion, one pair of opposed sidewalls connecting with said rails at a location spaced back from said base portion whereby said rails support said pans of a member in a predetermined spaced relationship in which said pans are aligned in one direction, and said members being positioned in substantially parallel spaced relationship, whereby said pans are aligned in another direction with associated pans of adjacent members, said support rails having a color substantially different from said pans which is selected to obscure the presence of said rails and to provide a system appearance of a pattern of separate rectangular pans having a depth at least equal to the length of said one pair of opposed sidewalls suspended in space.

2. A wall, ceiling, and the like as set forth in claim 1, wherein said members are formed of sheet material having a dark color on one side and a substantially lighter contrasting color on the other side, the exposed surface of said pans having said lighter color and the exposed surfaces of said support rails having said dark color.

3. A wall, ceiling, and the like as set forth in claim 1, wherein connecting means connect a plurality of said elongated members to form panels, and a support grid is provided, a plurality of said panels being mounted on said support grid.

4. A wall, ceiling, and the like as set forth in claim 1, wherein said substantially all of the spaces between adjacent pans are open in a direction back from said base portions.

5. A wall, ceiling, and the like as set forth in claim 4, wherein acoustical insulating material is positioned over said spaces and is exposed through said spaces to provide substantial sound absorption.

6. A wall, ceiling, and the like as set forth in claim 5, wherein said acoustical insulating material and said rails are a color substantially darker than the color of said pans, whereby said rails and said insulating material are not apparent through said spaces.

7. A wall, ceiling, and the like comprising a plurality of elongated members each providing a pair of parallel support rails extending the length thereof and a plurality of spaced substantially rectangular pans, each pan including a rectangular planar base portion and sidewalls extending back from the plane of said base portion, a pair of opposed sidewalls connecting with said rails whereby said rails support said pans of a member in a predetermined spaced relationship in which said pans are aligned in one direction, and said members being positioned in substantially parallel spaced relationship, whereby said pans are aligned in another direction with associated pans of adjacent members, said support rails having a color substantially different from said pans which is selected to obscure the presence of said rails and to provide a system appearance of a pattern of separate pans suspended in space, said rails being formed by reversely bending a portion of said sheet material so that said lighter color on the material forming said rails is concealed.

8. A wall, ceiling, and the like as set forth in claim 7, wherein said rails extend along planes inclined at a substantial angle back from the plane of said base portion.

9. A wall, ceiling, and the like as set forth in claim 7, wherein said rails are substantially wider than they are thick, and said rails extend in the direction of their width substantially perpendicular to the plane of said base portions.

10. An elongated member for walls, ceilings, and the like comprising a pair of rails extending the length thereof, and a plurality of rectangular pans spaced along said rails and supported thereby, said pans providing a rectangular, substantially planar base portion and four side portions extending back from the edges of said base portion, said rails being connected to a pair of opposite side portions along the edges of said pair of opposed side portions opposite said base portion, said rails being spaced back from said base portion by a distance at least equal to the width of said opposite side portions.

11. An elongated member as set forth in claim 10, wherein said members are integrally formed from a single piece of sheet metal.

12. An elongated member as set forth in claim 11, wherein said piece of sheet metal is formed into a generally U-shaped channel having a pair of legs and a substantially planar connecting portion between said legs, said connecting portion being cut at intervals along said channel and having portions adjacent to said cut bent back to provide a pair of said side portions, said connecting portion between associated bent portions forming said base portion of said pans, the other pair of said side portions being provided by a first part of said legs adjacent to said connecting portion, a second part of said legs providing said rails.

13. An elongated member as set forth in claim 12, wherein one side of said piece of sheet metal is provided with a dark color and the other side is provided with a contrasting lighter color, said other side providing the exterior of said pans, and said one side providing the exterior of said rails.

14. An elongated member as set forth in claim 13, wherein said second part of said legs is formed by reversely bending said sheet metal to expose said one side thereof on both sides of said rails.

15. A panel for walls, ceilings, and the like comprising a plurality of elongated members, means connecting said members in spaced parallel relationship, each member including a pair of rails extending the length thereof and a plurality of rectangular pans spaced along said rails and supported thereby, said pans providing a rectangular, substantially planar base portion and four side portions extending back from the edges of said base portion, said rails being connected with an opposed pair of said side portions along an edge of said opposed pair of said portions opposite said base portions, said rails being spaced back from said base portions by a distance at least equal to the width of said opposed pairs of side portions.

* * * * *